US008226492B2

(12) United States Patent
Hunter

(10) Patent No.: US 8,226,492 B2
(45) Date of Patent: Jul. 24, 2012

(54) WATER SLIDE

(75) Inventor: Richard D. Hunter, Ottawa (CA)

(73) Assignee: Proslide Technology Inc. (CA)

( * ) Notice: Subject to any disclaimer, the term of this patent is extended or adjusted under 35 U.S.C. 154(b) by 281 days.

(21) Appl. No.: 12/691,210

(22) Filed: Jan. 21, 2010

(65) Prior Publication Data

US 2011/0177872 A1 Jul. 21, 2011

(51) Int. Cl.
*A63G 21/18* (2006.01)
*A63G 21/00* (2006.01)

(52) U.S. Cl. ..... 472/117; 472/116

(58) Field of Classification Search ..... 472/13, 472/116–117, 128–129; 104/69–70
See application file for complete search history.

(56) References Cited

U.S. PATENT DOCUMENTS

| | | | |
|---|---|---|---|
| 728,246 | A | 5/1903 | Kremer |
| 929,567 | A | 5/1909 | Hayes |
| 953,266 | A | 3/1910 | Healy |
| 1,655,498 | A | 1/1928 | Fisch |
| 1,745,241 | A | 1/1930 | Bartlett |
| 2,254,482 | A | 9/1941 | Heller |
| D210,298 | S | 2/1968 | Moulton |
| 3,830,161 | A | 8/1974 | Bacon |
| 3,853,067 | A | 12/1974 | Bacon |
| 4,129,916 | A | 12/1978 | Schlesinger et al. |
| 4,172,593 | A | 10/1979 | Palakanis |
| 4,192,499 | A | 3/1980 | Groves, Jr. |
| D256,827 | S | 9/1980 | Allen |
| D256,828 | S | 9/1980 | Allen |
| D256,940 | S | 9/1980 | Allen |
| D257,874 | S | 1/1981 | Sheehan et al. |
| 4,278,247 | A | 7/1981 | Joppe et al. |
| 4,339,122 | A | 7/1982 | Croul |
| D266,346 | S | 9/1982 | Millay et al. |
| 4,444,290 | A | 4/1984 | Valerio, Jr. |
| 4,484,739 | A | 11/1984 | Kreinbihl et al. |
| 4,750,733 | A | 6/1988 | Foth |
| 4,805,896 | A | 2/1989 | Moody |
| 4,805,897 | A | 2/1989 | Dubeta |
| 4,836,521 | A | 6/1989 | Barber |
| 4,893,447 | A | 1/1990 | Opp et al. |
| 5,137,497 | A | 8/1992 | Dubeta |
| 5,433,671 | A | 7/1995 | Davis |
| 5,453,054 | A | 9/1995 | Langford |
| 5,482,510 | A | 1/1996 | Ishii et al. |
| 5,540,622 | A | 7/1996 | Gold et al. |

(Continued)

FOREIGN PATENT DOCUMENTS

| | | |
|---|---|---|
| GB | 2224948 | 5/1990 |

*Primary Examiner* — Kien Nguyen
(74) *Attorney, Agent, or Firm* — Barnes & Thornburg LLP

(57) ABSTRACT

A slide feature is adapted to carry one or more riders and/or ride vehicles sliding thereon. The slide feature includes a sliding surface having an entry end and an exit end. The sliding surface comprising a wall defined by a portion of a side of a funnel shape, tilted sideways, the wall comprising a top and a bottom. The bottom of the wall comprising a lowermost surface of the sliding surface and is horizontal or descending from the entry end to the exit end. The top of the wall curves upward from the lowermost surface past an angle of 90 degrees to the horizontal. A radius of curvature of the sliding surface tapers from the entry end to the exit end.

30 Claims, 7 Drawing Sheets

U.S. PATENT DOCUMENTS

| | | | | |
|---|---|---|---|---|
| 5,735,748 | A | 4/1998 | Meyers et al. | |
| 5,779,553 | A | 7/1998 | Langford | |
| 6,354,955 | B1 | 3/2002 | Stuart et al. | |
| 6,450,891 | B1 * | 9/2002 | Dubeta | 472/117 |
| 6,485,372 | B2 | 11/2002 | Stuart et al. | |
| 6,540,891 | B1 | 4/2003 | Stewart et al. | |
| 6,743,107 | B2 * | 6/2004 | Dubeta | 472/116 |
| 6,857,964 | B2 | 2/2005 | Hunter | |
| 7,056,220 | B2 | 6/2006 | Hunter | |
| 7,713,134 | B2 | 5/2010 | Hunter | |

* cited by examiner

WATER SLIDE

FIELD

The invention relates in general to water slide rides, and more particularly, to a water slide ride having a sliding wall.

BACKGROUND

Water slides are popular ride attractions for water parks, theme parks, family entertainment centers and destination resorts. Water slides not only offer welcome relief from the summer heat, they also provide an exciting and entertaining diversion from conventional pool and/or ocean bathing activities.

In one type of water slide, a bather or rider slides his body and/or a flexible riding mat, tube or raft ("ride vehicle") along a downward-inclined sliding surface defined by a flume or water channel that bends, twists and turns following a predetermined ride path. The flume also typically carries a flow of water from a starting pool at some desired higher elevation to a landing pool or run-out at a desired lower elevation. The water is typically continuously recirculated from the lower elevation to the higher elevation using one or more pumps and then continuously falls with gravity from the higher elevation to the lower elevation flowing along the slide/flume path. The water provides cooling fun for the ride participants, and also provides a lubricious film or fluid between the rider/vehicle and the ride surface so as to increase the speed of the rider down the flume path.

The popularity of water slides has increased dramatically over the years, as they have proliferated and evolved into ever larger and more exciting rides. For example, see U.S. Pat. No. 6,857,964, issued on Apr. 22, 2004, entitled "Reducing Radius Slide Feature", which is incorporated herein by reference. Nevertheless, park patrons continue to demand and seek out more and more exciting and stimulating ride experiences. Thus, there is an ever present demand and need for different and more exciting water slide designs that offer riders a new and unique ride experience and that give park owners the ability to draw larger and larger crowds to their parks.

SUMMARY OF THE INVENTION

According to a broad aspect, a slide feature adapted to carry one or more riders and/or ride vehicles sliding thereon comprises: a sliding surface having an entry end and an exit end; the sliding surface comprising a wall defined by a portion of a side of a funnel shape, tilted sideways, the wall comprising a top and a bottom; the bottom of the wall comprising a lowermost surface of the sliding surface and being horizontal or descending from the entry end to the exit end; the top of the wall curving upward from the lowermost surface past an angle of 90 degrees to the horizontal; wherein a radius of curvature of the sliding surface tapers from the entry end to the exit end.

In some embodiments, the radius of curvature of the sliding surface at the entry end is substantially larger than the radius of curvature of the sliding surface at the exit end.

In some embodiments, the entry end of the sliding surface further comprises an entry slide portion adapted to direct the riders/vehicles onto the sliding surface with sufficient tangential and axial velocity components for at least some of the riders/vehicles to travel up the wall at least partially above an angle of 90 degrees to the horizontal.

In some embodiments, the funnel shape is a right angle funnel shape.

In some embodiments, the entry end of the sliding surface further comprises an entry slide portion adapted to direct the riders/vehicles onto the sliding surface with predetermined expected tangential and axial velocity components.

In some embodiments, the slide feature further comprises an entry at the entry end and an exit at the exit end wherein the exit is less than ½ of the width of the lowermost surface of the wall.

In some embodiments, the exit is less than ⅓ of the width of the lowermost surface of the wall.

In some embodiments, the entry is less than ⅓ of the width of the lowermost surface of the wall.

In some embodiments, the top of the wall is substantially ellipsoid.

In some embodiments, the top of the wall is substantially linear.

In some embodiments, the sliding surface further comprises an outwardly curved safety wall along at least a portion of the wall for retaining riders/vehicles on the sliding surface.

In some embodiments, the radius of curvature of the sliding surface at the entry end is between about 10 and 50 feet.

In some embodiments, the radius of curvature of the sliding surface at the entry end is about 30 feet.

In some embodiments, the radius of curvature of the sliding surface at the exit end is between about 2 and 10 feet.

In some embodiments, the radius of curvature of the sliding surface at the exit end is about 6 feet.

In some embodiments, the ratio of the radius of curvature of the entry end and the exit end is between about 8:1 and 3:1.

In some embodiments, the ratio of the radius of curvature of the entry end and the exit end is between about 6:1 and 4:1.

In some embodiments, the ratio of the radius of curvature of the entry end and the exit end is about 5:1.

In some embodiments, the lowermost surface of the sliding surface is inclined from horizontal descending from the entry end to the exit end at an angle of between about 0 and 30 degrees from horizontal.

In some embodiments, the lowermost surface of the sliding surface is inclined from horizontal descending from the entry end to the exit end at an angle of about 5 degrees from horizontal.

In some embodiments, the height of the wall is about 40 feet.

According to a broad aspect, a slide feature adapted to carry one or more riders and/or ride vehicles sliding thereon comprises a curved sliding wall having an entry end, an exit end, a bottom and a top, the sliding wall being horizontal or tilted downward from the entry end to the exit end at an angle relative to horizontal, a longitudinal axis extending along the bottom of the sliding wall, an equator line on the sliding wall, the longitudinal axis and the equator line defining a plurality of pairs of points separated by a semi-circular arc of 90 degrees, wherein the semi-circular arcs have a radius of curvature that reduces from the entry end to the exit end of the slide feature.

In some embodiments, at least some riders and/or ride vehicles have sufficient velocity to travel at least partially above the equator line.

According to a broad aspect, a slide feature adapted to carry one or more riders and/or ride vehicles sliding thereon comprises: a sliding surface having an entry at a first end and an exit at a second end; the sliding surface comprising a wall having a top end and a bottom end; the bottom end of the wall comprising a lowermost surface of the sliding surface and being horizontal or descending from the entry end to the exit end, the lowermost surface having a width; the top of the wall curving upward from the lowermost surface past an angle of 90 degrees to the horizontal; wherein a radius of curvature of the sliding surface decreases from the entry end to the exit end; and wherein the exit is less than ⅓ of the width of the lowermost surface of the wall.

In some embodiments, the entry is less than ⅓ of the length of the lowermost surface of the wall.

In some embodiments, the length of the lowermost surface is about 40 feet and the width of the exit is about 14 feet.

According to a broad aspect, a slide feature adapted to carry one or more riders and/or ride vehicles sliding thereon comprises: a sliding surface defining a predetermined slide path; the sliding surface comprising an entry, a first portion, a second portion and an exit; the first portion being upwardly inclined from the entry and laterally curved outward; the second portion being downwardly inclined to the exit and laterally curved outward opposite to the first portion; wherein the first portion connects to the second portion.

In some embodiments, the first portion is upwardly inclined at a 4 to 12 percent slope and the second portion is downwardly inclined at a 4 to 12 percent slope.

In some embodiments, the first portion and the second portion together define an S-type curve.

In some embodiments, the sliding surface has a curved concave cross section with side walls to guide the rider along the ride path.

In some embodiments, the incline and curvature of the sliding surfaces are adapted to cause at least some of the riders and/or ride vehicles to travel at least partly on the side walls.

BRIEF DESCRIPTION OF THE DRAWINGS

Embodiments will now be described with reference to the attached drawings in which.

DETAILED DESCRIPTION

Figure 1:
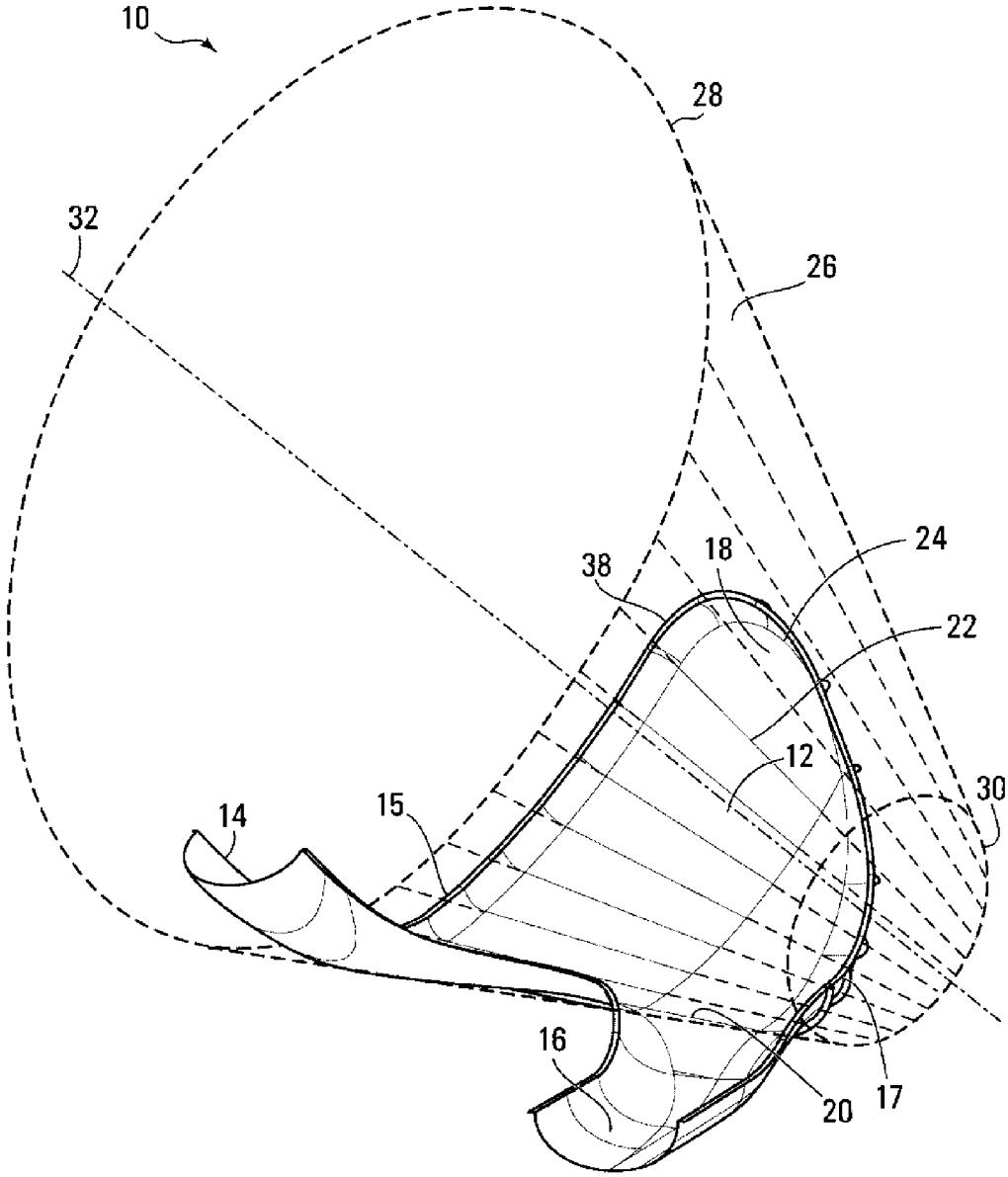
FIG. 1 is a perspective view of a water slide feature according to a first embodiment.
Figure 2:
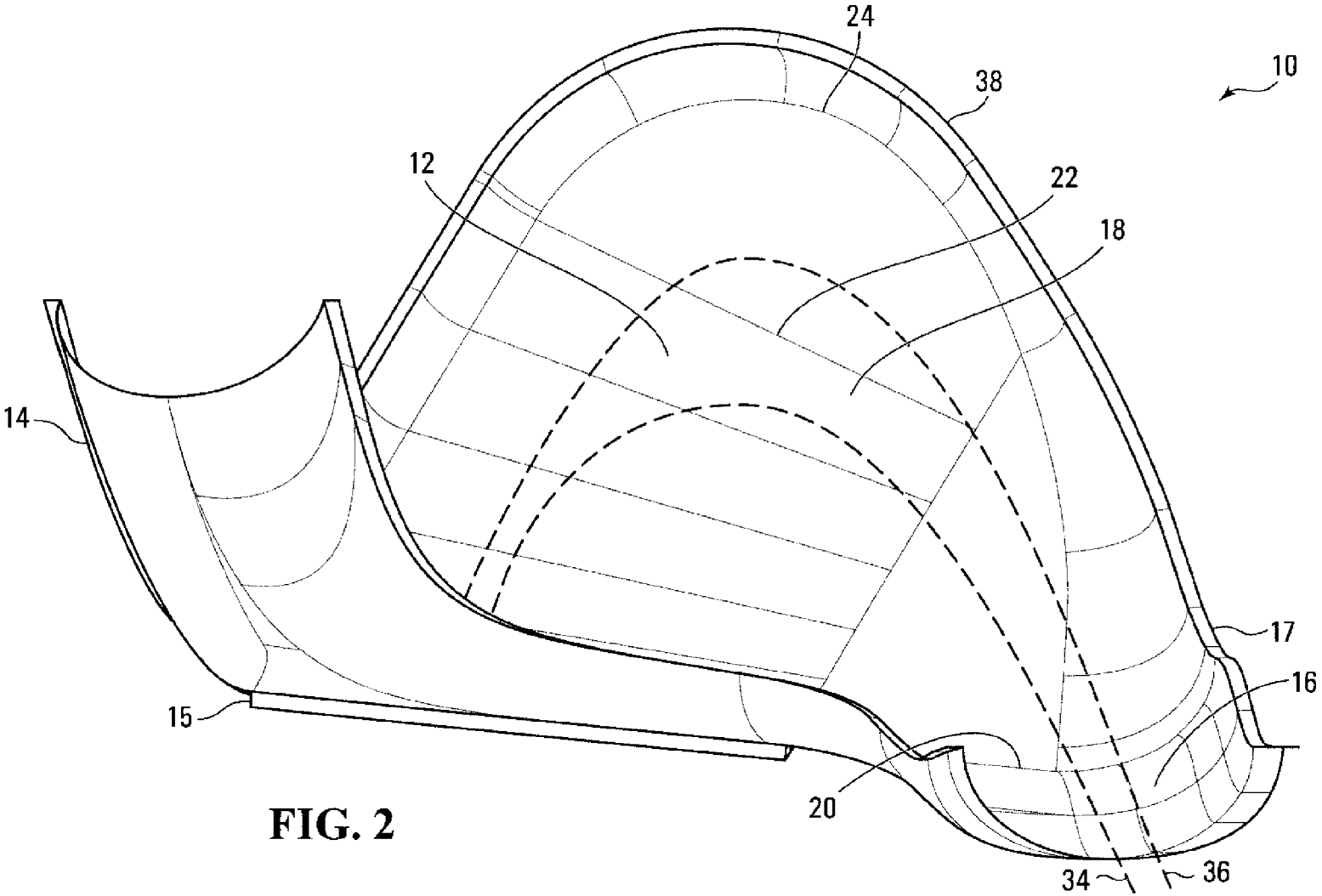
FIG. 2 is a front view thereof.
Figure 3:
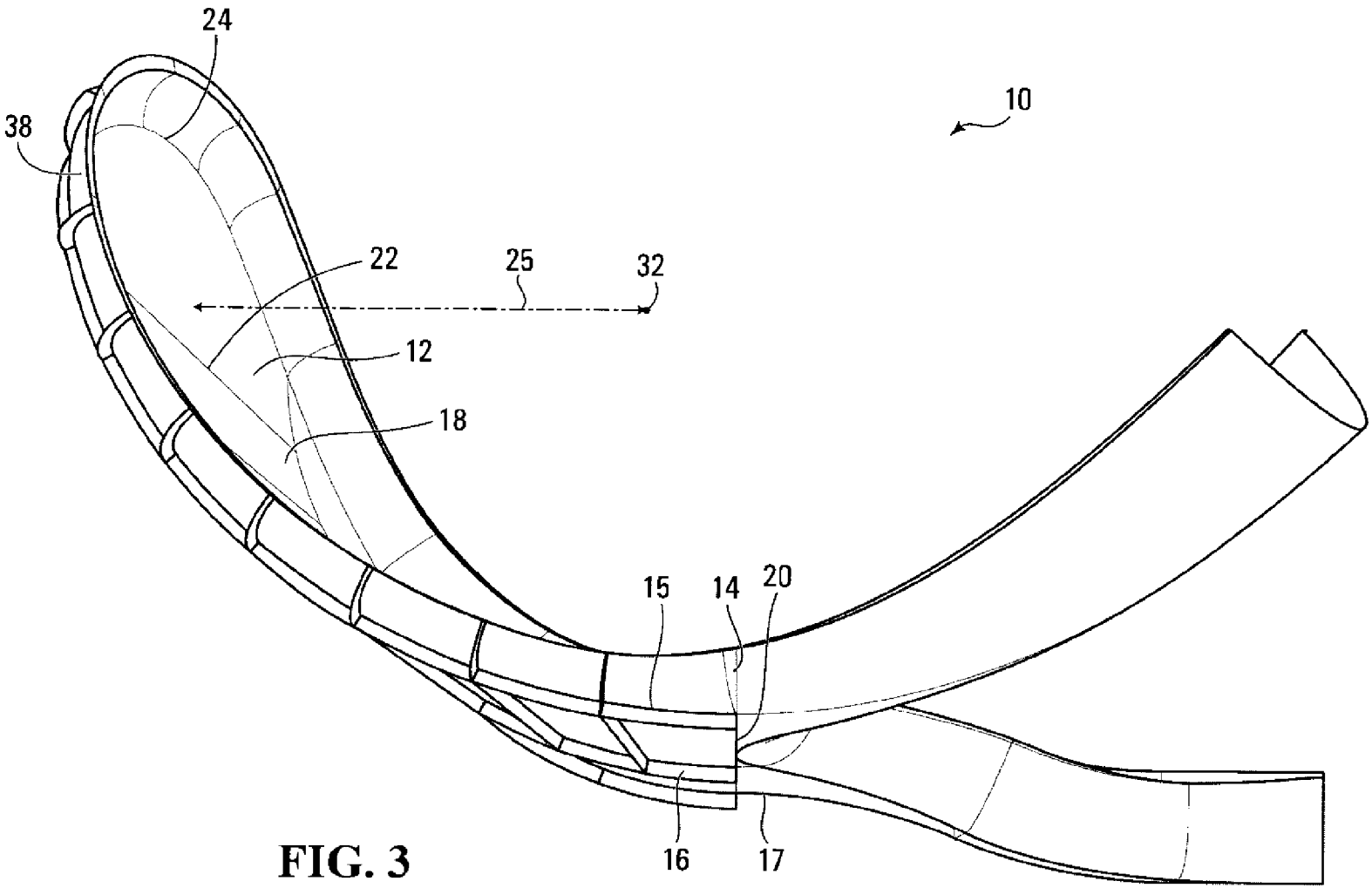
FIG. 3 is a side view thereof.

FIGS. 1, 2 and 3 depict a water slide feature 10. The water slide feature 10 includes a sliding surface 12. The sliding surface 12 has an entry 14 and an exit 16. The entry 14 is at an entry end 15 of the sliding surface 12 and the exit 16 is at and opposite exit end 17 of the sliding surface 12. The entry 14 and the exit 16 are both positioned on the same side of the sliding surface 12. In other words, the entry 14 and the exit 16 lie substantially in opposite directions but may be angled outward. For example, the entry 14 may be angled approximately 10 to 15 degrees outward from the entry end 15 and the exit 16 may be angled about 5 degrees outward from the exit end 17.

The sliding surface 12 comprises a wall 18. The wall 18 includes a bottom 20, and equator line 22 and a top 24. A cone or funnel shape 26 in stippled lines has been added to FIG. 1 to aid in describing the shape of the sliding surface 12. It will be understood that the complete cone or funnel shape 26 is not part of the water slide feature 10. The water slide feature 10 comprises only what is shown in solid lines.

The funnel shape 26 tapers from a wide end 28 to a narrow end 30. In this embodiment, the funnel shape 26 is a right angle funnel shape; however, non-right angle funnel shapes may form the basis of the shape of the sliding surface 12 of the water slide feature 10. The wide end 28 of the funnel shape 26 is at the entry end 15 of the sliding surface 12 and the narrower end 30 of the funnel shape 26 is at the exit end 17 of the sliding surface 12. The shape of the wall 18 is defined by the shape of the funnel shape 26. In particular, the wall 18 follows a shape which is a portion of the shape of the funnel shape 26. The wall 18 starts at a longitudinal axis defined by the bottom 20, which is a line down a side of the funnel shape 26. The wall 18 extends up following a side of the funnel shape 26 up past a 90 degree angle to the horizontal which may also be at a 90 degree angle to the longitudinal axis. For example, the wall may encompass an approximately 105 degree portion of the funnel shape 26. In the present embodiment, which is based on a right angle funnel, the longitudinal axis 20 and the equator line 22 define a plurality of pairs of points separated by a semi-circular arc of 90 degrees. The semi-circular arcs have a radius of curvature that reduces from the entry end 15 to the exit end 17 of the slide feature 10.

The bottom 20 is a lowest edge of the wall 18. The bottom 20 may be inclined slightly downward from the entry end 15 to the exit end 17 as best can be seen in FIGS. 2 and 3. In some embodiments, the lowermost surface of the sliding surface is inclined from horizontal descending from the entry end to the exit end at an angle of between 0 and 45 degrees from the horizontal. In some embodiments, the angle is about 5 degrees.

From the bottom 20 the wall 18 curves upward along a shape defined by the side of the funnel shape 26 up to a top 24. The entire shape of the wall 18 may be defined by the shape of the funnel shape 26. It will be appreciated, however, that the wall 18 is not the entire length of the side of the funnel shape 26. The wall 18 is only a portion of the side of the funnel shape 26.

The wall 18 extends past the equator line 22. The equator line 22 defines a line upon which the wall 18 is at a 90 degree angle or perpendicular to the horizontal. Above the equator line 22, as the wall 18 follows the funnel shape 26, the wall 18 curves inward and is at an angle of more than 90 degrees to the horizontal.

The funnel shape 26 has an axis of curvature 32. The axis of curvature 32 is the geometric axis of curvature about which the funnel shape 26 is curved. In a right angle funnel, the axis extends through the centre of the funnel. It will be appreciated that, because the wall 18 is a portion of the funnel shape 26, the wall 18 also curves about the same axis of curvature 32. A distance 25 (see FIG. 3) from the wall 18 to the axis of curvature 32 is the radius of curvature. It will be appreciated that the radius of curvature decreases from the wide end 28 to the narrow end 30 of the funnel shape. Consequently, the radius of curvature decreases from the entry end 15 to the exit end 17 of the sliding surface 12. The wall 18 therefore defines a reducing radius slide feature.

This reducing radius of the slide feature 10 helps to maintain the rider on the water slide feature 10 in contact with the water slide even when the rider travels above the equator line 22.

In this embodiment, the rider is accelerated and directed onto the sliding surface 12 through the downwardly inclined slide portion to the entry 14 by gravity. The path the riders will travel over the wall 18 will depend on a number of factors such as their weight and their distribution of their mass. In some embodiments the riders may travel in a ride vehicle, for example, a raft for one to six people or more. In other embodiments, the riders may body slide without a raft.

In FIG. 2, a first ride path 34 and a second ride path 36 are marked. These ride paths 34 and 36 are exemplary ride paths only. In both ride paths 34 and 36, the rider enters the sliding surface 12 through the entry 14 at the entry end 15. The rider then travels across the bottom 20 of the wall 18 then up the wall 18 while simultaneously travelling laterally across the wall 18. The rider then reaches a high point and begins to travel down the wall 18 while still traveling laterally across the wall 18 from the entry end 15 towards the exit end 17 and then out through the exit 16 at the exit end 17. On the first ride path 34, the rider does not travel above the equator 22 and on the second ride path 36 the rider does travel above the equator 22 and thus travels above a 90 degree angle with the horizontal. In other words, the rider travels through the vertical when travelling the second ride path 36. The riders are continuously moving on the wall 18. The riders do not stall or stop at the maximum height of travel because the riders are always moving across the wall 18 on a continuously curving path.

The ride paths 34 and 36 are not pre-selected. The path the rider travels will depend on a variety of factors; however, the ride path is predictable to the extent that the reducing radius shape of the wall 18 ensures that the riders will stay on the wall 18 irrespective of whether or not they travel above the equator line 22. Also, both ride paths direct the rider to the exit 16.

In this embodiment, the wall 18 has a partially ellipsoid, side and top perimeter as best seen in FIG. 2. Around the side and top perimeter is a safety lip 38. The safety lip 38 has a concave semi-circular cross-section with a radius of curvature of, for example, 2 feet. The rider will not normally ride on the safety lip 38. The safety lip 38 is provided only for safety reasons and may be omitted.

In this embodiment, the size of the water slide feature 10 is based on a funnel shape which has a diameter at the wide end 20 of 100 feet. In other words, a radius of curvature of 10 to 50 feet and may be about 30 feet. The funnel shape 26 tapers to a diameter of 4 to 20 feet at the exit or, in other words, a radius of curvature of 2 to 10 feet and may be about 6 feet. The radius of curvature of the sliding surface at the entry end may be substantially larger than the radius of curvature of the sliding surface of the exit end. The ratio of the radius of curvature of the entry end to the exit end may be between 8:1 and 3:1 or between 6:1 and 4:1 or about 5:1.

The predictability of the slide path means that a narrower exit may be used then could be used on a non-reduced radius wall. For example, in one embodiment, the width of the wall 18 at the bottom 20 from the entry end 15 to the exit end 17 is approximately 40 feet and the entry 14 and the exit 16 are approximately 14 feet wide. This means that the entry 14 and the exit 16 are less than one half, and even less than one third of the width of the wall 18. In such an embodiment, the height of the wall from the bottom to the top may be approximately 40 feet.

Figure 4:
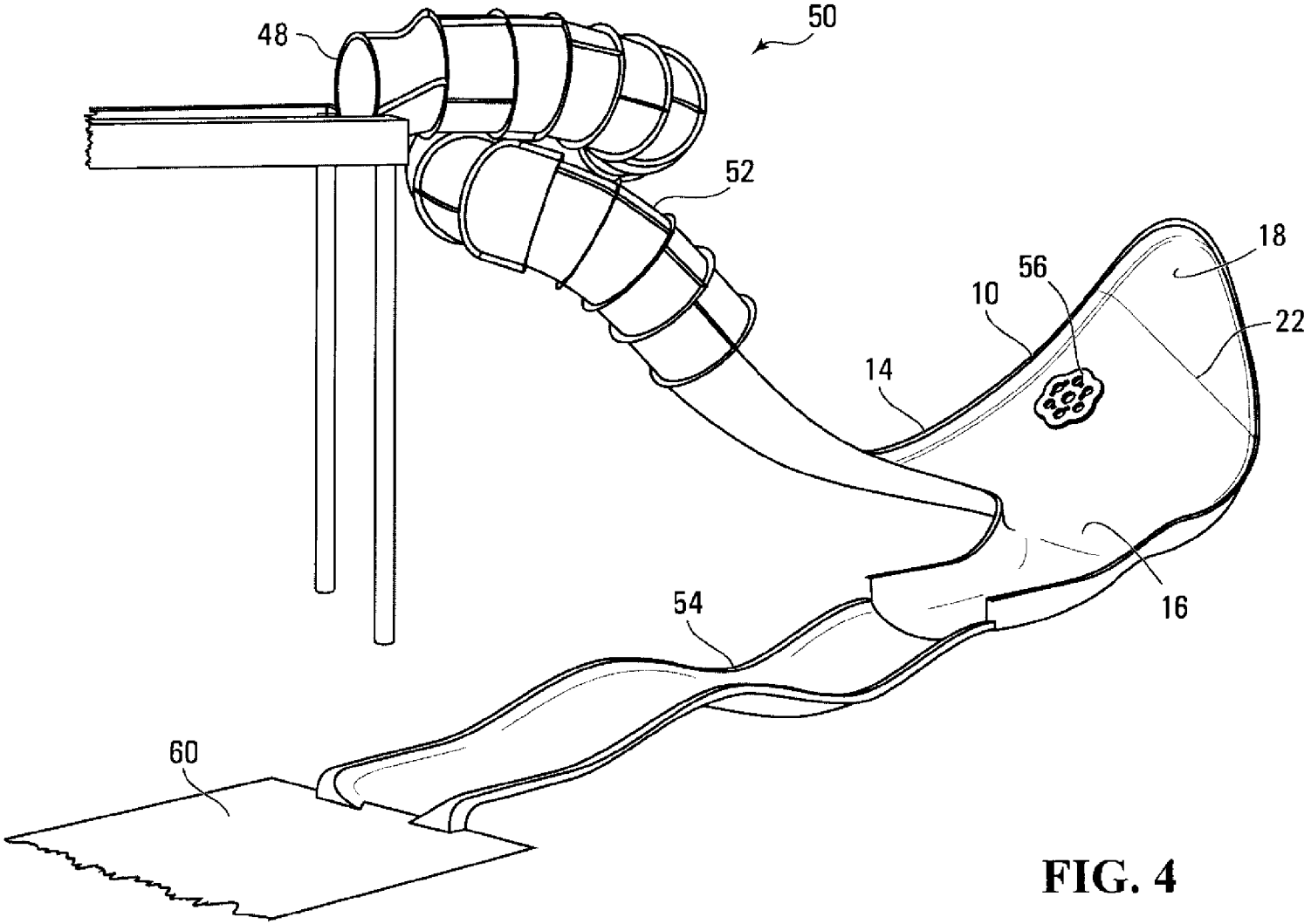
FIG. 4 is a perspective view of a water slide incorporating the water slide feature of the first embodiment.

FIG. 4 depicts a water slide 50 incorporating the water slide feature 10 of FIGS. 1 to 3. The water slide 50 incorporates an entrance opening 48, an entry slide portion 52 and an exit slide portion 54. In this embodiment, the riders travel on a raft 56. The raft 56 is an example of a six person raft. The riders have been omitted for simplicity. Raft 56 enters the water slide from a platform at the entrance opening 48 and travels through the entry slide portion 52. The entry portion 52 may include loops or be straight. In this embodiment, the entry slide portion 52 is downwardly inclined such that the raft 56 accelerates under gravity. The raft 56 then enters the slide feature 10 through the entry 14. The raft then travels up the wall 18 and then back down and exits the water slide feature 10 through the exit 16. The rider then travels along the exit slide portion 54 and exits the water slide 50 into a pool 60. Although not depicted, it will be understood that the water slide 50 is lubricated with water. The water may be supplied from the top and/or sprayed or otherwise added to the water slide 50, including the water slide feature 10 at appropriate locations.

In this embodiment, the entry slide portion 52 has a sufficient height and is angled to direct the rider/vehicles onto the sliding surface with sufficient tangential and axial velocity components for at least some of the riders/vehicles to travel up the wall 18 at least partially above the equator line 22 and thus above an angle of 90 degrees to the horizontal.

Figure 5:
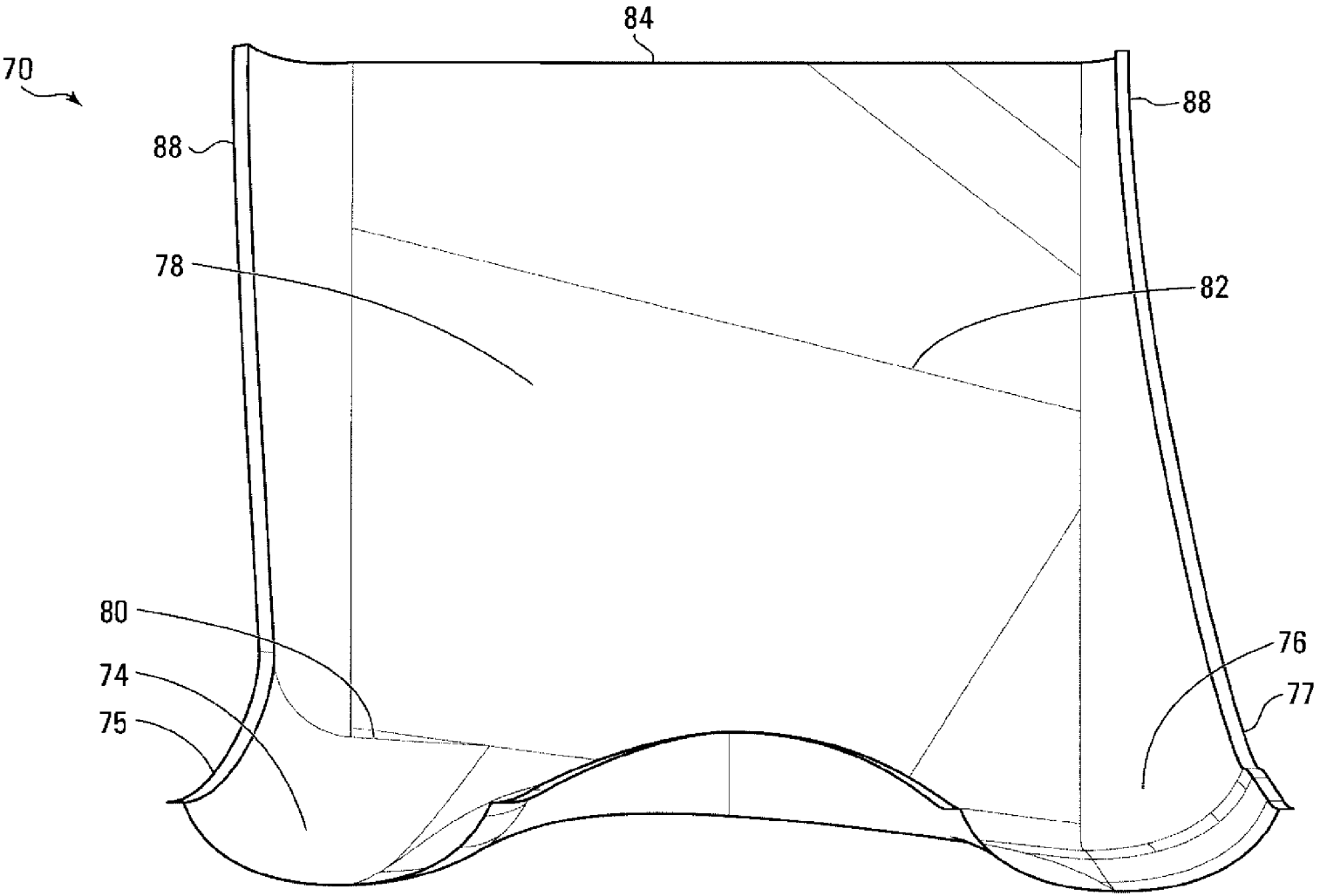
FIG. 5 is a front view of a water slide feature according to a second embodiment.

FIG. 5 shows another embodiment of the invention. This embodiment will only be described to the extent that it differs from the embodiment of FIGS. 1 to 4.

FIG. 5 depicts a water slide feature 70. The water slide feature 70 includes an entry 74 and an exit 76. The entry 74 is adjacent in entry end 75 and the exit 76 is adjacent an opposite exit end 75. A wall 78 extends between the entry end 75 and the exit end 77. The wall 78 has a bottom 80, an equator line 82 and a top 84. As with the first embodiment, the shape of the wall 78 follows the shape of a portion of funnel shape. The present embodiment differs from the first embodiment in that the portion of the funnel shape is a larger portion such that the wall 78 extends higher and has a substantially squared perimeter and the top 84 in linear. As in the first embodiment, the bottom 80 is the lowest point of the wall 78 and may be inclined downwardly from the entry 74 to the exit 76. In this embodiment, the wall 78 extends upward further beyond the equator line 82 (the line at which the wall 78 is at a 90 degree angle to the horizontal) then in the first embodiment. This permits the safety wall to be omitted from the top of the water slide in this embodiment. Instead, in this embodiment, inwardly curved safety walls 88 are found only along the sides of the wall 78. Additionally, in this embodiment, the riders are accelerated along a horizontal entry portion which connects to the entry 74 and accelerates the rider up the wall 18. This may, for example, constitute a linear induction motor system.

Although the illustrated embodiments show a wall defined by the shape of a funnel, for the portions of the wall which the rider will not travel on, there may be holes cut or other wall shapes that may deviate from the funnel shape. For example, a wave shape could be added at the top 84.

In some embodiments, the lowermost surface of the wall may not include the lowermost portion of the funnel shape. The lowermost surface of the wall could begin part way up the side of the funnel. In such embodiments, the equator line will still be 90 degrees to the horizontal but the angle between the lowermost surface and the equator line may be less than 90 degrees. This could be the case, for example, if a linear induction motor were used to accelerate a raft up an entry onto the wall as described in U.S. patent application Ser. No. 11/681,720, filed Mar. 2, 2007, entitled "Linear Motor Driven Waterslide Ride and Method", which is incorporated herein by reference.

Figure 6:
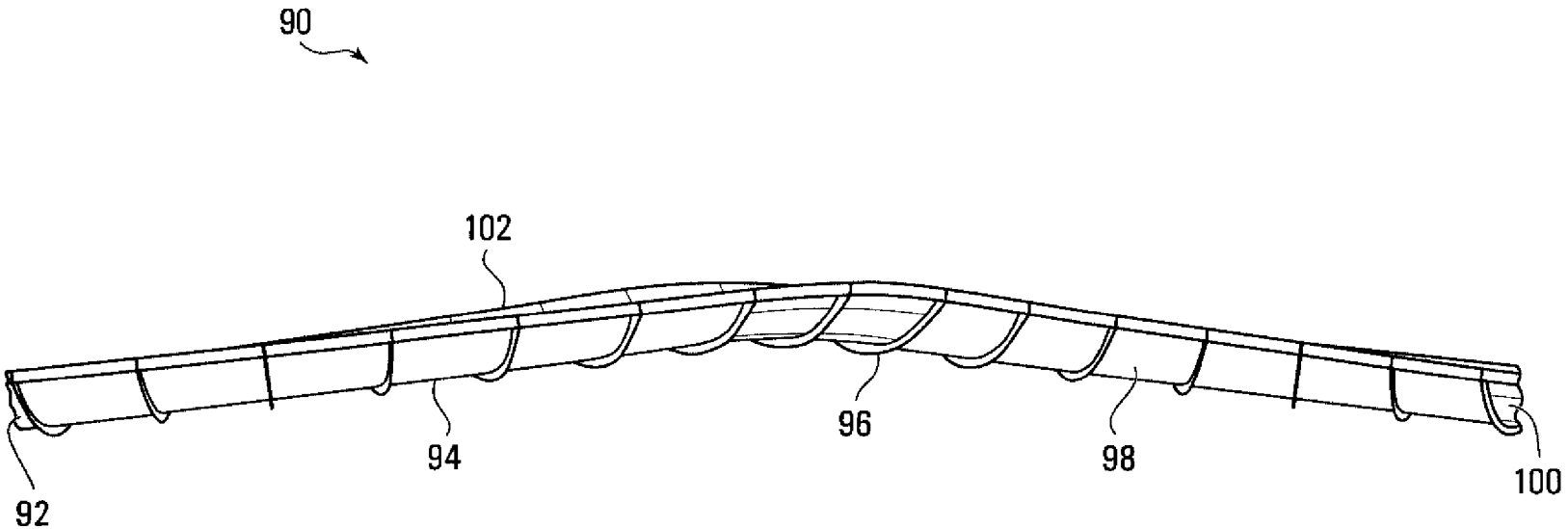
FIG. 6 is a side view of a water slide feature according to a third embodiment.
Figure 7:
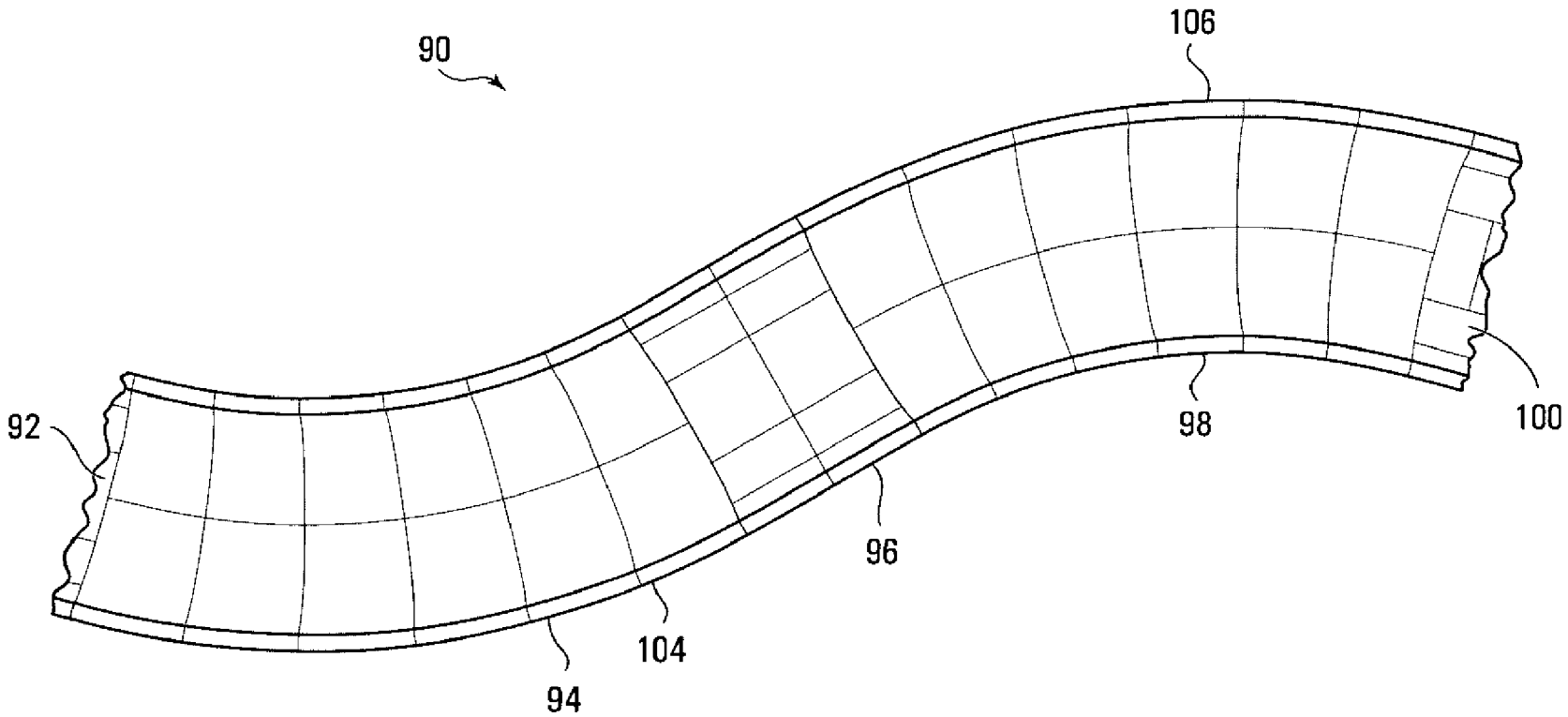
FIG. 7 is a top view of the water slide feature of FIG. 6.

In FIG. 4, the exit slide portion 54 is a generally downwardly sloping flume type slide portion. However, other exits portions are possible. The exit from the water slide feature 10 of FIGS. 1 to 4 or the exit from the water slide feature 70 of FIG. 5 could lead into a horizontal slide portion or an upwardly inclined slide portion that may be flume type or may be open, such as a mirror image of the slide feature 10 or 70. FIGS. 6 and 7 depict a curving angled slide feature 90 which may be the exit slide portion from the slide feature 10 or 70 or may form a portion of any water slide.

Turning first to the side view depicted in FIG. 6, the curving angled slide feature 90 includes an entrance 92, an upwardly angled section 94, a transition section 96, a downwardly angled section 98 and an exit 100. The curving angled slide feature 90 has a sliding surface 102. In this embodiment, the upward incline of the upwardly angled section 94 is an approximately 7 percent rise and the decline of the downwardly angled section 98 is approximately the same. However, the angle of incline may differ and be, for example 4 to 12 percent or more or less with an incline and subsequent decline of 3 to 12 feet over its length. Also the angle of incline and the angle of decline need not be the same and need not be constant over the entire length. For example, the section 98 may be horizontal. The transition section 96 is the section at which the upward angle changes to horizontal and then goes to the declined angle.

Turning to FIG. 7, a top view of the curving angled slide feature 90 is shown. From this view it can be seen that in addition to angling upward and downwards, the curving angled slide feature 90 also curves laterally outward and inward in an S-type curve. In particular, starting at the entrance 92, the upwardly angled section 94 curves outward in one direction to a maximum outward curve 104 and then curves back inward. The curving angled slide feature 90 straightens out briefly in the transition section 96. The downwardly angled section 98 then curves outward to a maximum outward curve 104 in an opposite direction to the curve in the upwardly angled section 94 and then back in to finish at the exit 100. The degree of curvature may vary and may differ between the angled sections 94 and 96. The angled sections 94 and 96 may also be of differing lengths and the entrance 92 and the exit 100 may be at differing vertical heights.

The sliding surface 102 may be a flume type sliding surface. Such a slide surface is concave with upwardly curving side walls. In some embodiments, the cross section across the sliding surface 102 may be elliptical, may be semicircular, may have a compound radius made up of four curvatures or more, or may be more squared as long as there is a bottom surface for a rider to slide on and side walls to direct the rider along the sliding path. The sliding surface 102 is lubricated with water which may enter and exit through the entrance 92 and the exit 100 or may be otherwise sprayed or introduced to the sliding surface 102.

The height of the side walls will depend on various factors including the incline and decline angles and the speed at which the rider enters the curving angled slide feature 90. It will be appreciated, that with an elliptical or semicircular cross-section, the rider may ride part of the way up the side walls, particularly at the bend in the outward curves 104 and 106. The side walls may therefore be higher at these locations. For example, the side wall may generally be 3 to 5 feet in height but may gradually increase around on the outer side of the curves to reach 9 feet at the maximum outward curves 104 and 106.

Numerous modifications and variations of the present invention are possible in light of the above teachings. It is therefore to be understood that within the scope of the appended claims, the invention may be practiced otherwise than as specifically described herein.

I claim:

1. A slide feature adapted to carry one or more riders and/or ride vehicles sliding thereon comprising:

a sliding surface having an entry end and an exit end;

the sliding surface comprising a wall defined by a portion of a side of a funnel shape, tilted sideways, the wall comprising a top and a bottom;

the bottom of the wall comprising a lowermost surface of the sliding surface and being horizontal or descending from the entry end to the exit end;

the top of the wall curving upward from the lowermost surface past an angle of 90 degrees to the horizontal;

wherein a radius of curvature of the sliding surface tapers from the entry end to the exit end.

2. The slide feature of claim 1 wherein the radius of curvature of the sliding surface at the entry end is substantially larger than the radius of curvature of the sliding surface at the exit end.

3. The slide feature of claim 1 wherein the entry end of the sliding surface further comprises an entry slide portion adapted to direct the riders/vehicles onto the sliding surface with sufficient tangential and axial velocity components for at least some of the riders/vehicles to travel up the wall at least partially above an angle of 90 degrees to the horizontal.

4. The slide feature of claim 3 wherein the funnel shape is a right angle funnel shape.

5. The slide feature of claim 1 wherein the funnel shape is a right angle funnel shape.

6. The slide feature of claim 1 wherein the entry end of the sliding surface further comprises an entry slide portion adapted to direct the riders/vehicles onto the sliding surface with predetermined expected tangential and axial velocity components.

7. The slide feature of claim 1 wherein the slide feature further comprises an entry at the entry end and an exit at the exit end wherein the exit is less than ½ of the width of the lowermost surface of the wall.

8. The slide feature of claim 7 wherein the exit is less than ⅓ of the width of the lowermost surface of the wall.

9. The slide feature of claim 8 wherein the entry is less than ⅓ of the width of the lowermost surface of the wall.

10. The slide feature of claim 1 wherein the top of the wall is substantially ellipsoid.

11. The slide feature of claim 1 wherein the top of the wall is substantially linear.

12. The slide feature of claim 1 wherein the sliding surface further comprises an outwardly curved safety wall along at least a portion of the wall for retaining riders/vehicles on the sliding surface.

13. The slide feature of claim 1 wherein the radius of curvature of the sliding surface at the entry end is between about 10 and 50 feet.

14. The slide feature of claim 1 wherein the radius of curvature of the sliding surface at the entry end is about 30 feet.

15. The slide feature of claim 1 wherein the radius of curvature of the sliding surface at the exit end is between about 2 and 10 feet.

16. The slide feature of claim 15 wherein the radius of curvature of the sliding surface at the exit end is about 6 feet.

17. The slide feature of claim 16 wherein the height of the wall is about 40 feet.

18. The slide feature of claim 1 wherein the ratio of the radius of curvature of the entry end and the exit end is between about 8:1 and 3:1.

19. The slide feature of claim 1 wherein the ratio of the radius of curvature of the entry end and the exit end is between about 6:1 and 4:1.

20. The slide feature of claim 1 wherein the ratio of the radius of curvature of the entry end and the exit end is about 5:1.

21. The slide feature of claim 1 wherein the lowermost surface of the sliding surface is inclined from horizontal descending from the entry end to the exit end at an angle of between about 0 and 30 degrees from horizontal.

22. The slide feature of claim 1 wherein the lowermost surface of the sliding surface is inclined from horizontal descending from the entry end to the exit end at an angle of about 5 degrees from horizontal.

23. The slide feature of claim 1 wherein the exit end of the sliding surface further comprises an exit slide portion, the exit slide portion comprising:

an exit slide portion sliding surface defining a predetermined slide path;

the exit slide portion sliding surface comprising an exit slide portion entry, a first portion, a second portion, and an exit slide portion exit;

the first portion being upwardly inclined from the exit slide portion entry and laterally curved outward;

the second portion being downwardly inclined to the exit slide portion exit and laterally curved outward opposite to the first portion;

wherein the first portion connects to the second portion.

24. The slide feature of claim 23 wherein the first portion and the second portion together define an S-type curve.

25. The slide feature of claim 23 wherein the exit slide portion sliding surface has a curved concave cross section with side walls to guide the rider along the ride path.

26. The slide feature of claim 25 wherein the incline and curvature of the sliding surfaces are adapted to cause at least some of the riders and/or ride vehicles to travel at least partly on the side walls.

27. A slide feature adapted to carry one or more riders and/or ride vehicles sliding thereon comprising a curved sliding wall having an entry end, an exit end, a bottom and a top, the sliding wall being horizontal or tilted downward from the entry end to the exit end at an angle relative to horizontal, a longitudinal axis extending along the bottom of the sliding wall, an equator line on the sliding wall, the longitudinal axis and the equator line defining a plurality of pairs of points separated by a semi-circular arc of 90 degrees, wherein the semi-circular arcs have a radius of curvature that reduces from the entry end to the exit end of the slide feature.

28. A slide feature adapted to carry one or more riders and/or ride vehicles sliding thereon comprising:

a sliding surface having an entry at a first end and an exit at a second end;

the sliding surface comprising a wall having a top end and a bottom end;

the bottom end of the wall comprising a lowermost surface of the sliding surface and being horizontal or descending from the entry end to the exit end, the lowermost surface having a width;

the top of the wall curving upward from the lowermost surface past an angle of 90 degrees to the horizontal;

wherein a radius of curvature of the sliding surface decreases from the entry end to the exit end; and wherein the exit is less than ⅓ of the width of the lowermost surface of the wall.

29. The slide feature of claim 28 wherein the entry is less than ⅓ of the length of the lowermost surface of the wall.

30. The slide feature of claim 29 wherein the length of the lowermost surface is about 40 feet and the width of the exit is about 14 feet.

* * * * *